US009863410B2

(12) United States Patent
Kim et al.

(10) Patent No.: US 9,863,410 B2
(45) Date of Patent: Jan. 9, 2018

(54) LINEAR COMPRESSOR

(71) Applicant: LG ELECTRONICS INC., Seoul (KR)

(72) Inventors: Junghae Kim, Seoul (KR); Kyoungkyu Lee, Seoul (KR); Kwangwoon Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 287 days.

(21) Appl. No.: 14/643,422

(22) Filed: Mar. 10, 2015

(65) Prior Publication Data

US 2015/0369224 A1 Dec. 24, 2015

(30) Foreign Application Priority Data

Jun. 24, 2014 (KR) ..... 10-2014-0077559

(51) Int. Cl.
*F04B 39/02* (2006.01)
*F04B 35/04* (2006.01)
(Continued)

(52) U.S. Cl.
CPC ..... *F04B 39/0292* (2013.01); *F04B 35/045* (2013.01); *F04B 39/122* (2013.01);
(Continued)

(58) Field of Classification Search
CPC ... F04B 39/0292; F04B 39/041–39/048; F04B 39/121–39/123; F04B 35/04;
(Continued)

(56) References Cited

U.S. PATENT DOCUMENTS 3,542,202 A * 11/1970 Ball ..... B01D 29/00 210/232
2006/0048523 A1* 3/2006 Kwon ..... F04B 35/045 62/114
(Continued)

FOREIGN PATENT DOCUMENTS

BR WO 2013071382 A2 * 5/2013 ..... F04B 35/045
CN 101395373 3/2009
(Continued)

OTHER PUBLICATIONS

European Search Report dated Feb. 18, 2016 issued in Application No. 15163981.2.
Chinese Office Action dated Dec. 27, 2016 (English Translation).

*Primary Examiner* — Charles Freay
*Assistant Examiner* — Kenneth J Hansen
(74) *Attorney, Agent, or Firm* — Ked & Associates, LLP

(57) ABSTRACT

A linear compressor is provided. The linear compressor may include a shell including a suction inlet, a cylinder provided in the shell to define a compression space for a refrigerant, a piston reciprocated in an axial direction within the cylinder, a discharge valve provided on or at one side of the cylinder to selectively discharge the refrigerant compressed in the compression space, at least one nozzle disposed in the cylinder to introduce at least a portion of the refrigerant discharged through the discharge valve into the cylinder, and a passage to guide the refrigerant discharged from the discharge valve to the at least one nozzle.

14 Claims, 17 Drawing Sheets

(51) Int. Cl.
*F04B 39/12* (2006.01)
*F04B 53/00* (2006.01)

(52) U.S. Cl.
CPC ..... *F04B 39/123* (2013.01); *F04B 39/126* (2013.01); *F04B 53/008* (2013.01)

(58) Field of Classification Search
CPC ..... F04B 35/045; F04B 7/14; F04B 53/008; F04B 39/064; F04B 39/126; F15B 15/1485; F15B 15/149
See application file for complete search history.

(56) References Cited

U.S. PATENT DOCUMENTS

| | | | | |
|---|---|---|---|---|
| 2009/0238701 | A1* | 9/2009 | Giacchi | F04B 39/16 417/321 |
| 2010/0046862 | A1* | 2/2010 | Schubert | F04B 35/045 384/12 |
| 2010/0218548 | A1 | 9/2010 | Giacchi et al. | |

FOREIGN PATENT DOCUMENTS

| | | | |
|---|---|---|---|
| CN | 101512154 | | 8/2009 |
| CN | 101535643 | | 9/2009 |
| CN | 103629082 | | 3/2014 |
| EP | 0 994 253 | | 4/2000 |
| EP | 2700816 | A1 | 2/2014 |
| KR | 10-2009-0044884 | A | 5/2009 |
| WO | WO 2013/071382 | A2 | 5/2013 |

* cited by examiner

LINEAR COMPRESSOR

CROSS-REFERENCE TO RELATED APPLICATION(S)

This application claims priority under 35 U.S.C. §119 to Korean Application No. 10-2014-0077559, filed in Korea on Jun. 24, 2014, whose entire disclosure is hereby incorporated by reference.

BACKGROUND

1. Field

A linear compressor is disclosed herein.

2. Background

In general, compressors are machines that receive power from a power generation device, such as an electric motor or turbine, to compress air, a refrigerant, or various working gases, thereby increasing in pressure. Compressors are being widely used in home appliances, such as refrigerators or air conditioners, or industrial fields.

Compressors may be largely classified into reciprocating compressors, in which a compression space into and from which a working gas is suctioned and discharged, is defined between a piston and a cylinder to allow the piston to be linearly reciprocated in the cylinder, thereby compressing the working gas; rotary compressors, in which a compression space into and from which a working gas is suctioned or discharged, is defined between a roller that eccentrically rotates and a cylinder to allow the roller to eccentrically rotate along an inner wall of the cylinder, thereby compressing the working gas; and scroll compressors, in which a compression space into and from which a working gas is suctioned or discharged, is defined between an orbiting scroll and a fixed scroll to compress the working gas while the orbiting scroll rotates along the fixed scroll. In recent years, a linear compressor, which is directly connected to a drive motor, in which a piston is linearly reciprocated, to improve compression efficiency without mechanical losses due to movement conversion and has a simple structure, is being widely developed.

The linear compressor may suction and compress a working gas, such as a refrigerant, while the piston is linearly reciprocated in a sealed shell by a linear motor, and then discharge the working gas. The linear motor may include a permanent magnet disposed between an inner stator and an outer stator. The permanent magnet may be linearly reciprocated by an electromagnetic force between the permanent magnet and the inner (or outer) stator. As the permanent magnet operates in a state in which the permanent magnet is connected to the piston, a refrigerant may be suctioned and compressed while the piston is linearly reciprocated within the cylinder, and then, may be discharged.

The present Applicant filed a patent (hereinafter, referred to as a "prior document") and then registered the patent with respect to the linear compressor, as Korean Patent No. 10-1307688, filed on Sep. 5, 2013 and entitled "linear compressor", which is hereby incorporated by reference. The linear compressor according to the prior art document includes a shell that accommodates a plurality of components. A vertical height of the shell may be somewhat high, as illustrated in the prior art document. An oil supply assembly to supply oil between a cylinder and a piston may be disposed within the shell.

When the linear compressor is provided in a refrigerator, the linear compressor may be disposed in a machine chamber provided at a rear side of the refrigerator. In recent years, a major concern of customers is increasing an inner storage space of the refrigerator. To increase the inner storage space of the refrigerator, it may be necessary to reduce a volume of the machine room. To reduce the volume of the machine room, it may be important to reduce a size of the linear compressor.

However, as the linear compressor disclosed in the prior art document has a relatively large volume, the linear compressor is not adequate for a refrigerator, for which an increased inner storage space is sought. To reduce the size of the linear compressor, it may be necessary to reduce a size of a main component of the compressor. In this case, a performance of the compressor may deteriorate.

To compensate for the deteriorated performance of the compressor, it may be necessary to increase to a drive frequency of the compressor. However, the more the drive frequency of the compressor is increased, the more a friction force due to oil circulating in the compressor increases, deteriorating performance of the compressor.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. The embodiments may, however, be embodied in many different forms and should not be construed as being limited to the embodiments set forth herein; rather, alternate embodiments falling within the spirit and scope will fully convey the concept to those skilled in the art.

Figure 1:
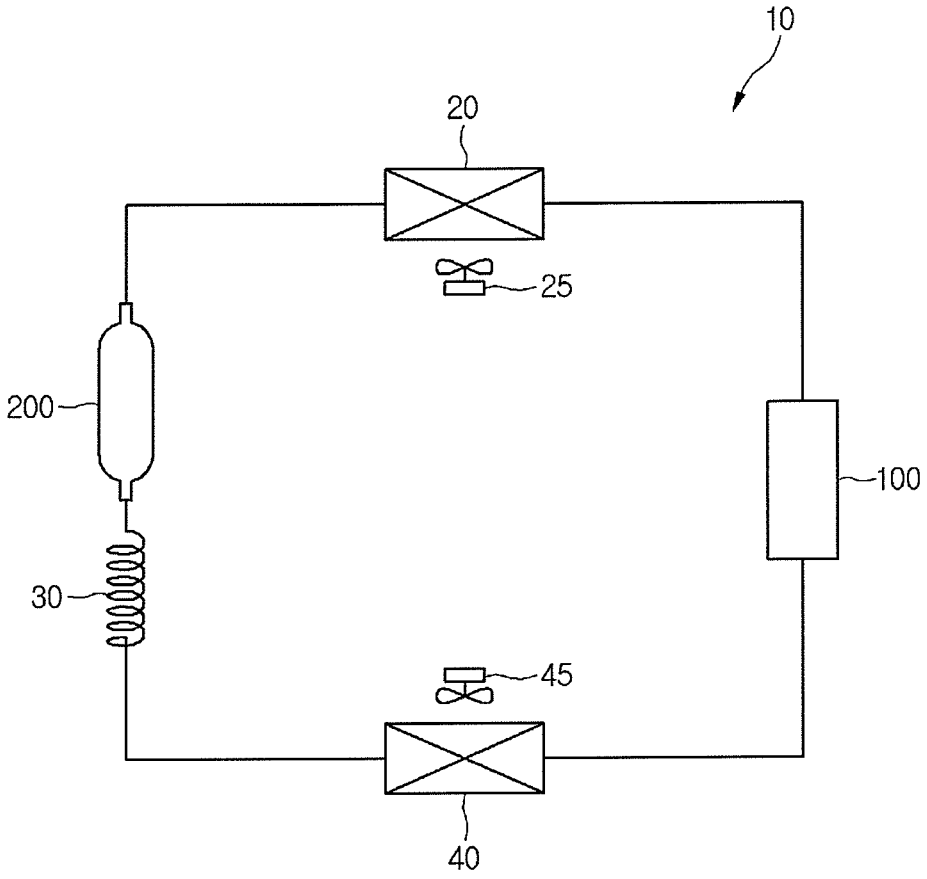
FIG. 1 is a schematic diagram of a refrigerator according to an embodiment.

FIG. 1 is a schematic diagram of a refrigerator according to an embodiment. Referring to FIG. 1, a refrigerator 10 according to an embodiment may include a plurality of devices to drive a refrigeration cycle.

In detail, the refrigerator 10 may include a compressor 100 that compresses a refrigerant, a condenser 20 that condenses the refrigerant compressed in the compressor 100, a dryer 200 that removes moisture, foreign substances, or oil from the refrigerant condensed in the condenser 20, an expansion device 30 that decompresses the refrigerant having passed through the dryer 200, and an evaporator 40 that evaporates the refrigerant decompressed in the expansion device 30. The refrigerator 10 may further include a condensation fan 25 to blow air toward the condenser 20, and an evaporation fan 45 to blow air toward the evaporator 40.

The compressor 100 may be a linear compressor, in which a piston may be directly connected to a motor to compress the refrigerant while the piston is linearly reciprocated within a cylinder. The expansion device 30 may include a capillary tube having a relatively small diameter.

A liquid refrigerant condensed in the condenser 20 may be introduced into the dryer 200. A gaseous refrigerant may be partially contained in the liquid refrigerant. At least one filter to filter the liquid refrigerant introduced into the dryer 200 may be provided in the dryer 200. Hereinafter, components of the dryer 200 will be described with reference to the accompanying drawings.

Figure 2:
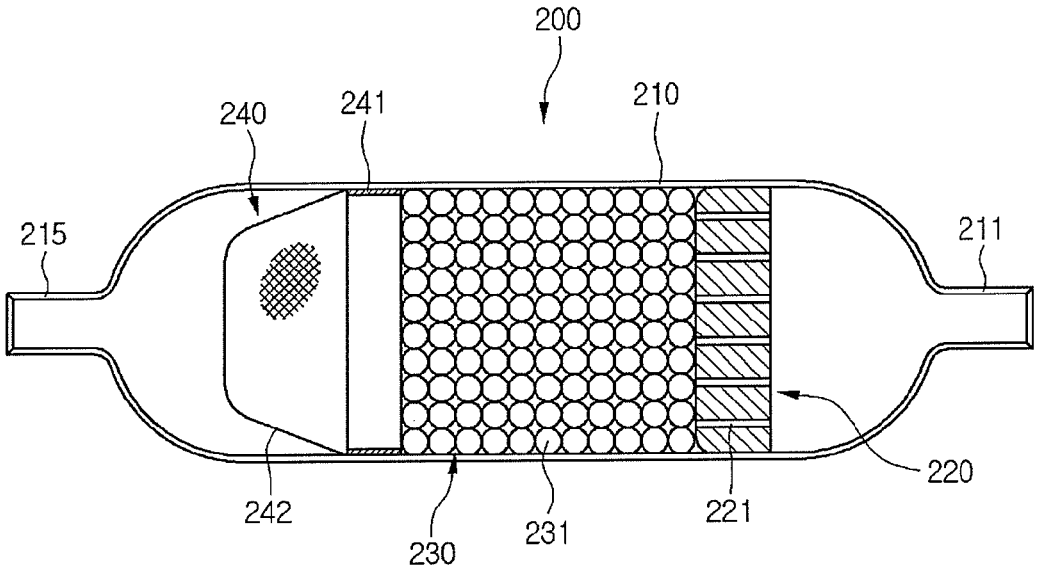
FIG. 2 is a cross-sectional view of a dryer of a refrigerator according to an embodiment.

FIG. 2 is a cross-sectional view of a dryer of a refrigerator according to an embodiment. Referring to FIG. 2, the dryer 200 according to an embodiment may include a dryer body 210 that defines a flow space of the refrigerant, a refrigerant inflow 211 disposed on or at one or a first side of the dryer body 210 to guide introduction of the refrigerant, and a refrigerant discharge 215 disposed on or at the other or a second side of the dryer body 210 to guide discharge of the refrigerant. For example, the dryer body 210 may have a long cylindrical shape.

Dryer filters 220, 230, and 240 may be provided in the dryer body 210. In detail, the dryer filters 220, 230, and 240 may include a first dryer filter 220 disposed adjacent to the refrigerant inflow 211, a third dryer filter 240 spaced apart from the first dryer filter 220 and disposed adjacent to the refrigerant discharge 215, and a second dryer filter 230 disposed between the first dryer filter 220 and the third dryer filter 240.

The first dryer filter 220 may be disposed adjacent to an inside of the refrigerant inflow 211, that is, disposed at a position closer to the refrigerant inflow 211 than the refrigerant discharge 215. The first dryer filter 220 may have an approximately hemispherical shape. An outer circumferential surface of the first dryer filter 220 may be coupled to an inner circumferential surface of the dryer body 210. A plurality of through holes 221 to guide flow of the refrigerant may be defined in the first dryer filer 220. A foreign substance having a relatively large volume may be filtered by the first dryer filter 220.

The second dryer filter 230 may include a plurality of adsorbents 231. Each of the adsorbents 231 may be a grain having a predetermined size. The adsorbent 231 may be a molecular sieve and have a predetermined size of about 5 mm to about 10 mm.

A plurality of holes may be defined in the adsorbent 231. Each of the plurality of holes may have a size similar to a size of oil (about 10 Å). The hole may have a size greater than a size (about 2.8 Å to about 3.2 Å) of the moisture and a size (about 4.0 Å in case of R134a, and about 4.3 Å in case of R600a) of the refrigerant. The term "oil" may refer to a working oil or cutting oil injected when components of the refrigeration cycle are manufactured or processed.

The refrigerant and moisture having passed through the first dryer filter 220 may be easily discharged even though the refrigerant and moisture are easily introduced into the plurality of holes while passing through the adsorbents 231. Thus, the refrigerant and moisture may not be easily adsorbed onto the adsorbents 231. However, if the oil is introduced into the plurality of holes, the oil may not be easily discharged, and thus, may be maintained in a state in which the oil is adsorbed onto the adsorbents 231.

For example, the adsorbent 231 may include a BASF 13X molecular sieve. A hole defined in the BASF 13X molecular sieve may have a size of about 10 Å (1 nm), and the BASF 13X molecular sieve may be expressed as a chemical formula: $Na_2O.Al_2O_3.mSiO_2.nH_2O$ ($m \leq 2.35$).

The oil contained in the refrigerant may be adsorbed onto or into the plurality of adsorbents 231 while passing through the second dryer filter 230. Alternatively, the second dryer filter 230 may include an oil adsorbent paper or an adsorbent having a felt, instead of the plurality of adsorbents each of which has a grain shape.

The third dryer filter 240 may include a coupling portion 241 coupled to the inner circumferential surface of the dryer body 210, and a mesh 242 that extends from the coupling portion 241 toward the refrigerant discharge 215. The third dryer filer 240 may be referred to as a mesh filter. A foreign substance having a fine size contained in the refrigerant may be filtered by the mesh 242.

Each of the first dryer filter 220 and the third dryer filter 240 may serve as a support to locate the plurality of adsorbents 231 within the dryer body 210. That is, discharge of the plurality of adsorbents 231 from the dryer 200 may be restricted by the first and third dryer filters 220 and 240.

As described above, the filters may be provided in the dryer 200 to remove foreign substances or oil contained in the refrigerant, thereby improving reliability of the refrigerant that acts as a gas bearing.

Figure 3:
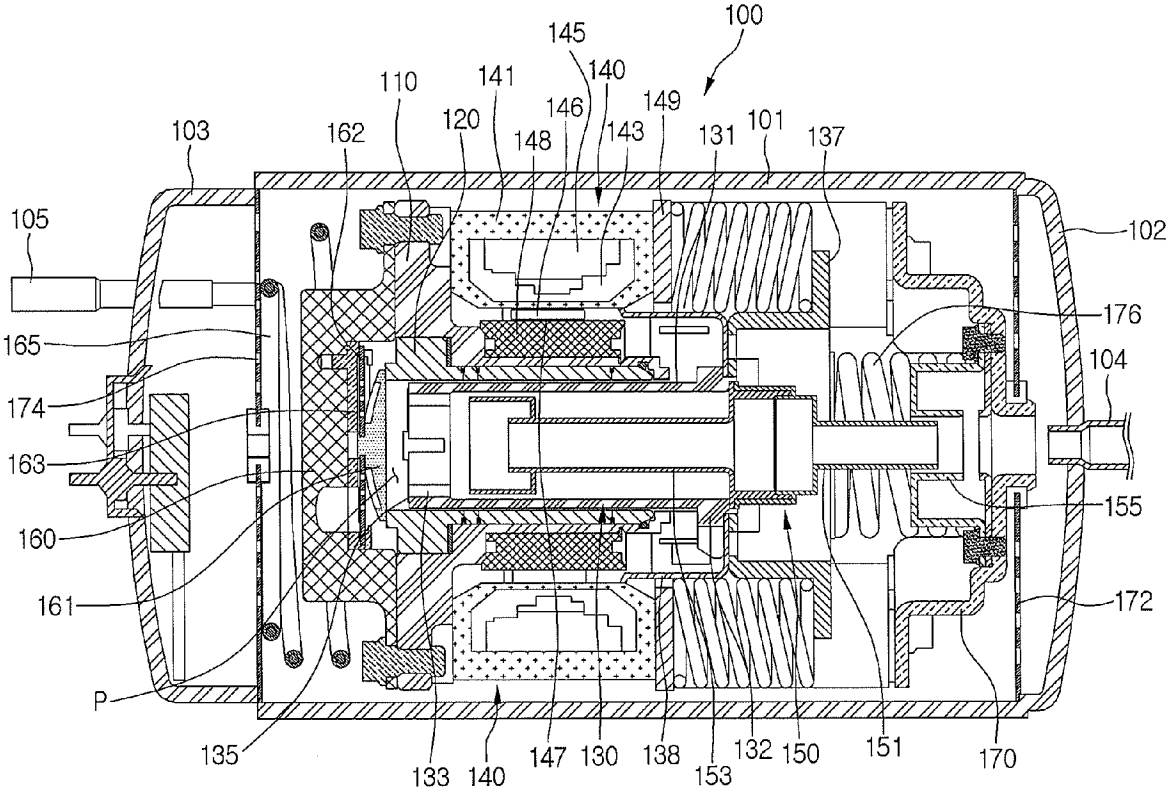
FIG. 3 is a cross-sectional view of a linear compressor according to an embodiment.

FIG. 3 is a cross-sectional view of a linear compressor according to an embodiment. Referring to FIG. 3, the linear compressor 100 according to an embodiment may include a shell 101 having an approximately cylindrical shape, a first cover 102 coupled to one or a first side of the shell 101, and a second cover 103 coupled to the other or a second side of the shell 101. For example, the linear compressor 100 may be laid out in a horizontal direction. The first cover 102 may be coupled to a right or first lateral side of the shell 101, and the second cover 103 may be coupled to a left or second lateral side of the shell 101. Each of the first and second covers 102 and 103 may be understood as one component of the shell 101.

The linear compressor 100 may include a cylinder 120 provided in the shell 101, a piston 130 linearly reciprocated within the cylinder 120, and a motor assembly 140 that serves as a linear motor to apply a drive force to the piston 130. When the motor assembly 140 operates, the piston 130 may be linearly reciprocated at a high rate. The linear compressor 100 according to this embodiment may have a drive frequency of about 100 Hz.

The linear compressor 100 may further include a suction inlet 104, through which the refrigerant may be introduced, and a discharge outlet 105, through which the refrigerant compressed in the cylinder 120 may be discharged. The suction inlet 104 may be coupled to the first cover 102, and the discharge outlet 105 may be coupled to the second cover 103.

The refrigerant suctioned in through the suction inlet 104 may flow into the piston 130 via a suction muffler 150. While the refrigerant passes through the suction muffler 150, noise may be reduced. The suction muffler 150 may be configured by coupling a first muffler 151 to a second muffler 153. At least a portion of the suction muffler 150 may be disposed within the piston 130.

The piston 130 may include a piston body 131 having an approximately cylindrical shape, and a piston flange 132 that extends from the piston body 131 in a radial direction. The piston body 131 may be reciprocated within the cylinder 120, and the piston flange 132 may be reciprocated outside of the cylinder 120.

The piston 130 may be formed of a nonmagnetic material, such as an aluminum material, such as aluminum or an aluminum alloy. As the piston 130 is formed of the aluminum material, a magnetic flux generated in the motor assembly 140 may not be transmitted into the piston 130, and thus, may be prevented from leaking outside of the piston 130. Also, as the piston 130 has a low weight, the piston 130 may be easily reciprocated. The piston 130 may be manufactured by a forging process, for example.

The cylinder 120 may be formed of a nonmagnetic material, such as an aluminum material, such as aluminum or an aluminum alloy. Also, the cylinder 120 and the piston 130 may have a same material composition, that is, a same kind and composition.

As the cylinder 120 may be formed of the aluminum material, a magnetic flux generated in the motor assembly 200 may not be transmitted into the cylinder 120, and thus, may be prevented from leaking outside of the cylinder 120. The cylinder 120 may be manufactured by an extruding rod processing process, for example.

Also, as the piston 130 may be formed of the same material (aluminum) as the cylinder 120, the piston 130 may have a same thermal expansion coefficient as the cylinder 120. When the linear compressor 100 operates, a high-temperature (a temperature of about 100° C.) environment may be created within the shell 100. Thus, as the piston 130 and the cylinder 120 have the same thermal expansion coefficient, the piston 130 and the cylinder 120 may be thermally deformed by a same degree. As a result, the piston 130 and the cylinder 120 may be thermally deformed with sizes and in directions different from each other to prevent the piston 130 from interfering with the cylinder 120 while the piston 430 moves.

The cylinder 120 may accommodate at least a portion of the suction muffler 150 and at least a portion of the piston 130. The cylinder 120 may have a compression space P, in which the refrigerant may be compressed by the piston 130. A suction hole 133, through which the refrigerant may be introduced into the compression space P, may be defined in or at a front portion of the piston 130, and a suction valve 135 to selectively open the suction hole 133 may be disposed on or at a front side of the suction hole 133. A coupling hole, to which a predetermined coupling member may be coupled, may be defined in an approximately central portion of the suction valve 135.

A discharge cover 160 that defines a discharge space or discharge passage for the refrigerant discharged from the compression space P, and a discharge valve assembly 160, 162, and 163 coupled to the discharge cover 160 to selectively discharge the refrigerant compressed in the compression space P may be provided at a front side of the compression space P. The discharge valve assembly 161, 162, and 163 may include a discharge valve 161 to introduce the refrigerant into the discharge space of the discharge cover 160 when a pressure within the compression space P is above a predetermined discharge pressure, a valve spring 162 disposed between the discharge valve 161 and the discharge cover 160 to apply an elastic force in an axial direction, and a stopper 163 that restricts deformation of the valve spring 162.

The term "compression space P" may be refer to as a space defined between the suction valve 135 and the discharge valve 161. The term "axial direction" may refer to a direction in which the piston 130 is reciprocated, that is, a transverse direction in FIG. 3. In the axial direction, a direction from the suction inlet 104 toward the discharge outlet 105, that is, a direction in which the refrigerant flows may be defined as a "frontward direction", and a direction opposite to the frontward direction may be defined as a "rearward direction". On the other hand, the term "radial direction" may refer to a direction perpendicular to the direction in which the piston 130 is reciprocated, that is, a horizontal direction in FIG. 7.

The stopper 163 may be seated on the discharge cover 160, and the valve spring 162 may be seated at a rear side of the stopper 163. The discharge valve 161 may be coupled to the valve spring 162, and a rear portion or rear surface of the discharge valve 161 may be supported by a front surface of the cylinder 120. The valve spring 162 may include a plate spring, for example.

The suction valve 135 may be disposed on or at one or a first side of the compression space P, and the discharge valve 161 may be disposed on or at the other or a second side of the compression space P, that is, a side opposite of the suction valve 135.

While the piston 130 is linearly reciprocated within the cylinder 120, when the pressure of the compression space P is below the predetermined discharge pressure and a predetermined suction pressure, the suction valve 135 may be opened to suction the refrigerant into the compression space P. On the other hand, when the pressure of the compression space P is above the predetermined suction pressure, the refrigerant may be compressed in the compression space P in a state in which the suction valve 135 is closed.

When the pressure of the compression space P is above the predetermined discharge pressure, the valve spring 162 may be deformed to open the discharge valve 161. The refrigerant may be discharged from the compression space P into the discharge space of the discharge cover 160.

The refrigerant flowing into the discharge space of the discharge cover 160 may be introduced into a loop pipe 165. The loop pipe 165 may be coupled to the discharge cover 160 to extend to the discharge outlet 105, thereby guiding the compressed refrigerant in the discharge space into the discharge outlet 105. For example, the loop pipe 165 may have a shape that is wound in a predetermined direction and extends in a rounded shape. The loop pipe 165 may be coupled to the discharge outlet 105.

The linear compressor 100 may further include a frame 110. The frame 110 may fix the cylinder 120 and be coupled to the cylinder 120 by a separate coupling member, for example. The frame 110 may surround the cylinder 120. That is, the cylinder 120 may be accommodated within the frame 110. Also, the discharge cover 172 may be coupled to a front surface of the frame 110.

At least a portion of the high-pressure gas refrigerant discharged through the opened discharge valve 161 may flow toward an outer circumferential surface of the cylinder 120 through a space at a portion at which the cylinder 120 and the frame 110 are coupled to each other. The refrigerant may be introduced into the cylinder 120 through one or more gas inflow (see reference numeral 122 of FIG. 7) and one or more nozzle (see reference numeral 123 of FIG. 7), which may be defined in the cylinder 120. The introduced refrigerant may flow into a space defined between the piston 130 and the cylinder 120 to allow an outer circumferential surface of the piston 130 to be spaced apart from the inner circumferential surface of the cylinder 120. Thus, the introduced refrigerant may serve as a "gas bearing" that reduces friction between the piston 130 and the cylinder 120 while the piston 200 is reciprocated.

The motor assembly 140 may include outer stators 141, 143, and 145 fixed to the frame 110 and disposed to surround the cylinder 120, an inner stator 148 disposed to be spaced inward from the outer stators 141, 143, and 145, and a permanent magnet 146 disposed in a space between the outer stators 141, 143, and 145 and the inner stator 148. The permanent magnet 146 may be linearly reciprocated by a mutual electromagnetic force between the outer stators 141, 143, and 145 and the inner stator 148. The permanent magnet 146 may be a single magnet having one polarity, or a plurality of magnets having three polarities.

The permanent magnet 146 may be coupled to the piston 130 by a connection member 138, for example. In detail, the connection member 138 may be coupled to the piston flange 132 and be bent to extend toward the permanent magnet 146. As the permanent magnet 146 is reciprocated, the piston 130 may be reciprocated together with the permanent magnet 146 in the axial direction.

The motor assembly 140 may further include a fixing member 147 to fix the permanent magnet 146 to the connection member 138. The fixing member 147 may be formed of a composition in which a glass fiber or carbon fiber is mixed with a resin. The fixing member 147 may be provided to surround an outside of the permanent magnet 146 to firmly maintain a coupled state between the permanent magnet 146 and the connection member 138.

The outer stators 141, 143, and 145 may include coil winding bodies 143 and 145, and a stator core 141. The coil winding bodies 143 and 145 may include a bobbin 143, and a coil 145 wound in a circumferential direction of the bobbin 143. The coil 145 may have a polygonal cross-section, for example, a hexagonal cross-section. The stator core 141 may be manufactured by stacking a plurality of laminations in a circumferential direction and be disposed to surround the coil winding bodies 143 and 145.

A stator cover 149 may be disposed on or at one side of the outer stators 141, 143, and 145. One or a first side of the outer stators 141, 143, and 145 may be supported by the frame 110, and the other or a second side of the outer stators 141, 143, and 145 may be supported by the stator cover 149.

The inner stator 148 may be fixed to a circumference of the frame 110. Also, in the inner stator 148, a plurality of laminations may be stacked in a circumferential direction outside of the frame 110.

The linear compressor 100 may further include a support 137 that supports the piston 130, and a back cover 170 spring-coupled to the support 137. The support 137 may be coupled to the piston flange 132 and the connection member 138 by a predetermined coupling member, for example.

A suction guide 155 may be coupled to a front portion of the back cover 170. The suction guide 155 may guide the refrigerant suctioned through the suction inlet 104 to introduce the refrigerant into the suction muffler 150.

The linear compressor 100 may also include a plurality of springs 176, which are adjustable in natural frequency, to allow the piston 130 to perform a resonant motion. The plurality of springs 176 may include a first spring supported between the support 137 and the stator cover 149, and a second spring supported between the support 137 and the back cover 170.

The linear compressor 100 may further include plate springs 172 and 174, respectively, disposed on both lateral sides of the shell 101 to allow inner components of the compressor 100 to be supported by the shell 101. The plate springs 172 and 174 may include a first plate spring 172 coupled to the first cover 102, and a second plate spring 174 coupled to the second cover 103. For example, the first plate spring 172 may be fitted into a portion at which the shell 101 and the first cover 102 are coupled to each other, and the second plate spring 174 may be fitted into a portion at which the shell 101 and the second cover 103 are coupled to each other.

Figure 4:
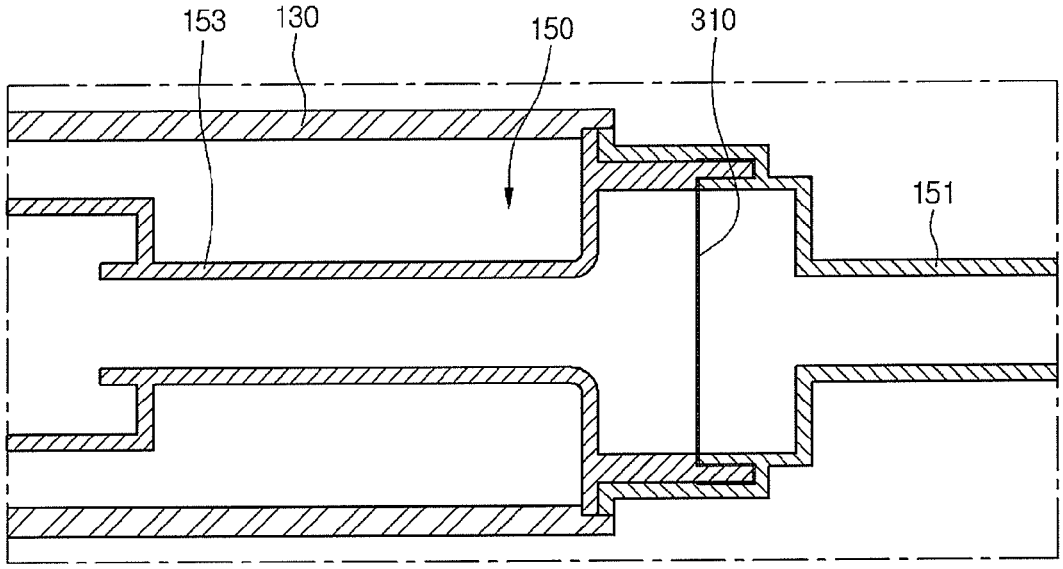
FIG. 4 is a cross-sectional view of a suction muffler according to an embodiment.
Figure 5:
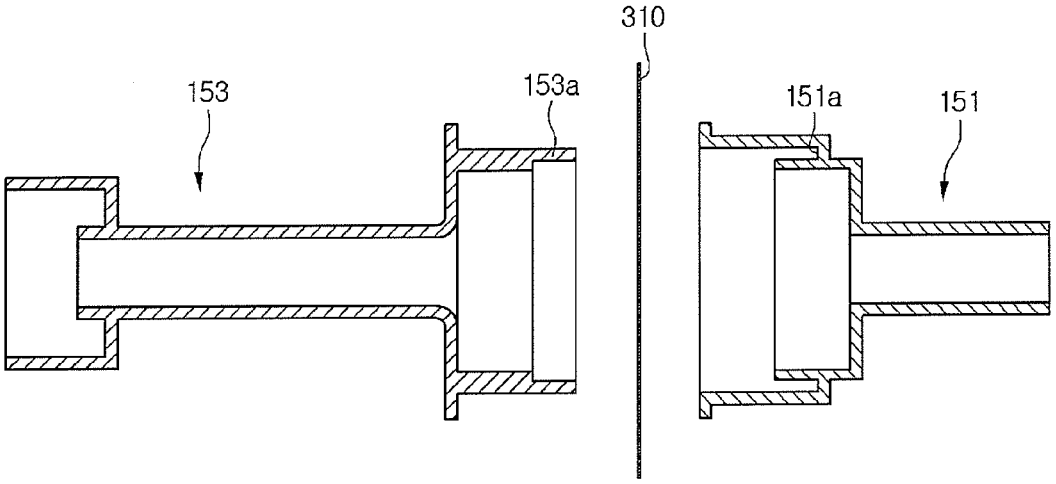
FIG. 5 is a view illustrating a position of a first filter coupled to the suction muffler according to an embodiment.

FIG. 4 is a cross-sectional view of a suction muffler according to an embodiment. FIG. 5 is a view illustrating a state of a first filter coupled to the suction muffler according to an embodiment.

Referring to FIGS. 4 and 5, the suction muffler 150 according to this embodiment may include the first muffler 151, the second muffler 153 coupled to the first muffler 151, and a first filter 310 supported by the first and second mufflers 151 and 153. A flow space, in which the refrigerant may flow may be defined in each of the first and second mufflers 151 and 153. The first muffler 151 may extend from an inside of the suction inlet 104 in a direction of the discharge outlet 105, and at least a portion of the first muffler 151 may extend inside of the suction guide 155. The second muffler 153 may extend from the first muffler 151 to an inside of the piston body 131.

The first filter 310 may be disposed in the flow space to filter foreign substances. The first filter 310 may be formed of a material having a magnetic property. Thus, foreign substances contained in the refrigerant, in particular, metallic substances, may be easily filtered. The first filter 310 may be formed of stainless steel, for example, and thus, have a magnetic property to prevent the first filter 310 from rusting. As another example, the first filter 310 may be coated with a magnetic material, or a magnet may be attached to a surface of the first filter 310.

The first filter 310 may be a mesh-type structure and have an approximately circular plate shape. Each filter hole of the first filter 310 may have a diameter or width less than a predetermined diameter or width. For example, the predetermined size may be about 25 μm.

The first muffler 151 and the second muffler 153 may be assembled with each other using a press-fit manner, for example. The first filter 310 may be fitted into a portion at which the first and second mufflers 151 and 153 are coupled or press-fitted together, and then, may be assembled.

In detail, a groove 151*a*, to which at least a portion of the second muffler 153 may be coupled, may be defined in the first muffler 151. The second muffler 153 may include a protrusion 153*a* inserted into the groove 151*a* of the first muffler 151. The first filter 310 may be supported by the first and second mufflers 151 and 153 in a state in which both sides of the first filter 310 may be disposed between the groove 151*a* and the protrusion 153*a*. In a state in which the first filter 310 is disposed between the first and second mufflers 151 and 153, when the first and second mufflers 151 and 153 move in a direction that approach each other and then are press-fitted, both sides of the first filter 310 may be inserted and fixed between the groove 151*a* and the protrusion 153*a*.

As described above, as the first filter 310 is provided on the suction muffler 150, a foreign substance having a size greater than a predetermined size of the refrigerant suctioned through the suction inlet 104 may be filtered by the first filter 310. Thus, the first filter 310 may filter foreign substance from the refrigerant acting as the gas bearing between the piston 130 and the cylinder 120 to prevent the foreign substance from being introduced into the cylinder 120. Also, as the first filter 310 is firmly fixed to the portion at which the first and second mufflers 151 and 153 are coupled or press-fitted, separation of the first filter 310 from the suction muffler 150 may be prevented.

In this embodiment, although the groove 151*a* is defined in the first muffler 151, and the protrusion 153*a* is disposed on the second muffler 153, embodiments are not limited thereto. For example, the protrusion 153*a* may be disposed on the first muffler 151, and the groove 151*a* may be defined in the second muffler 153.

Figure 6:
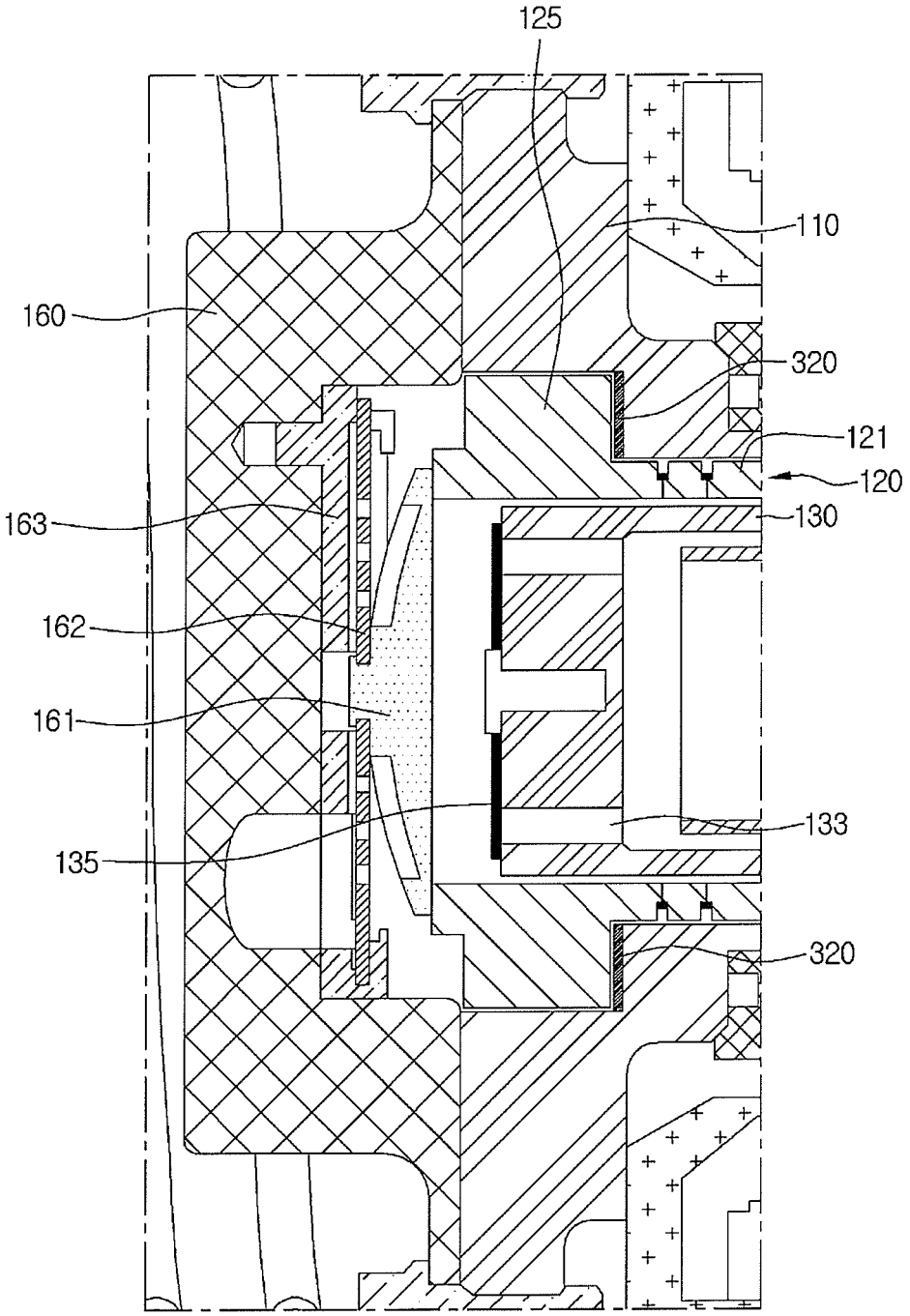
FIG. 6 is a view illustrating components around a compression chamber according to an embodiment.
Figure 7:
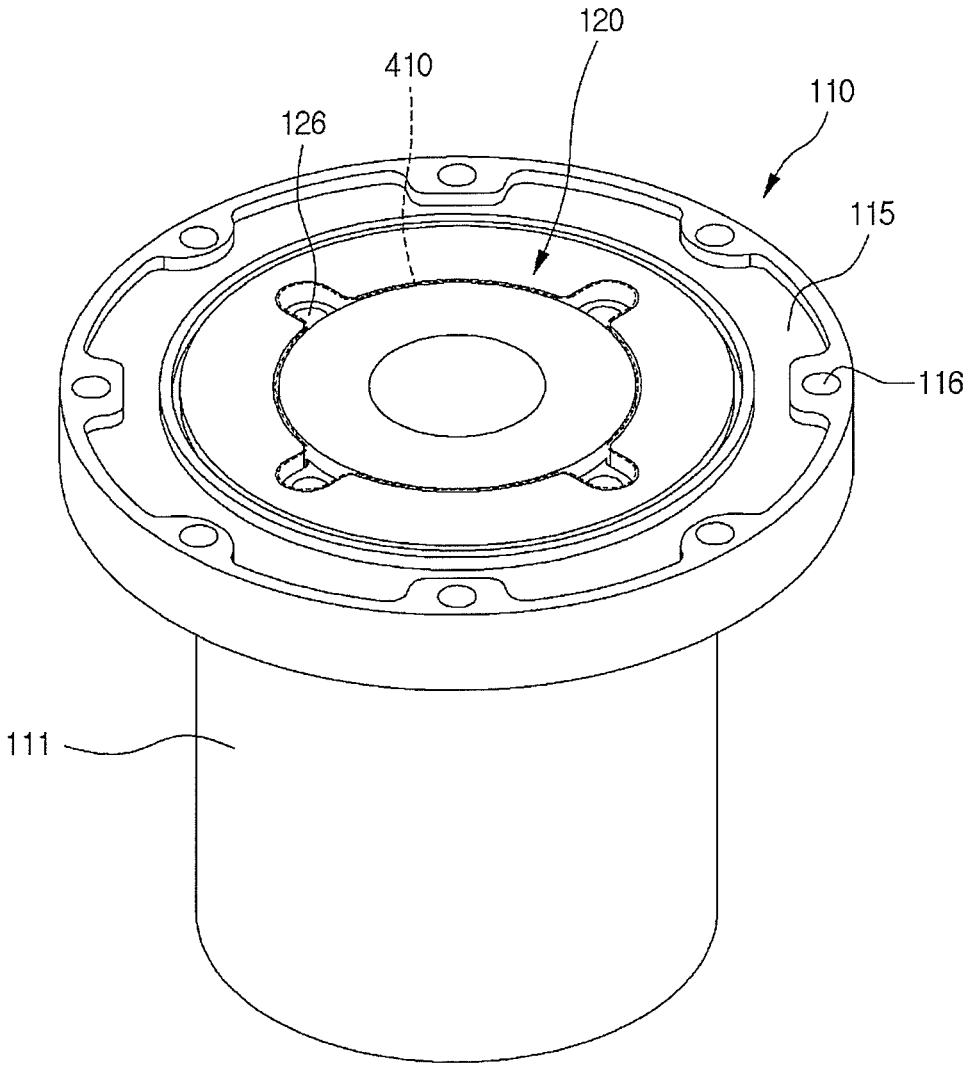
FIG. 7 is an exploded perspective view of a coupled state between a cylinder and a frame according to an embodiment.
Figure 8:
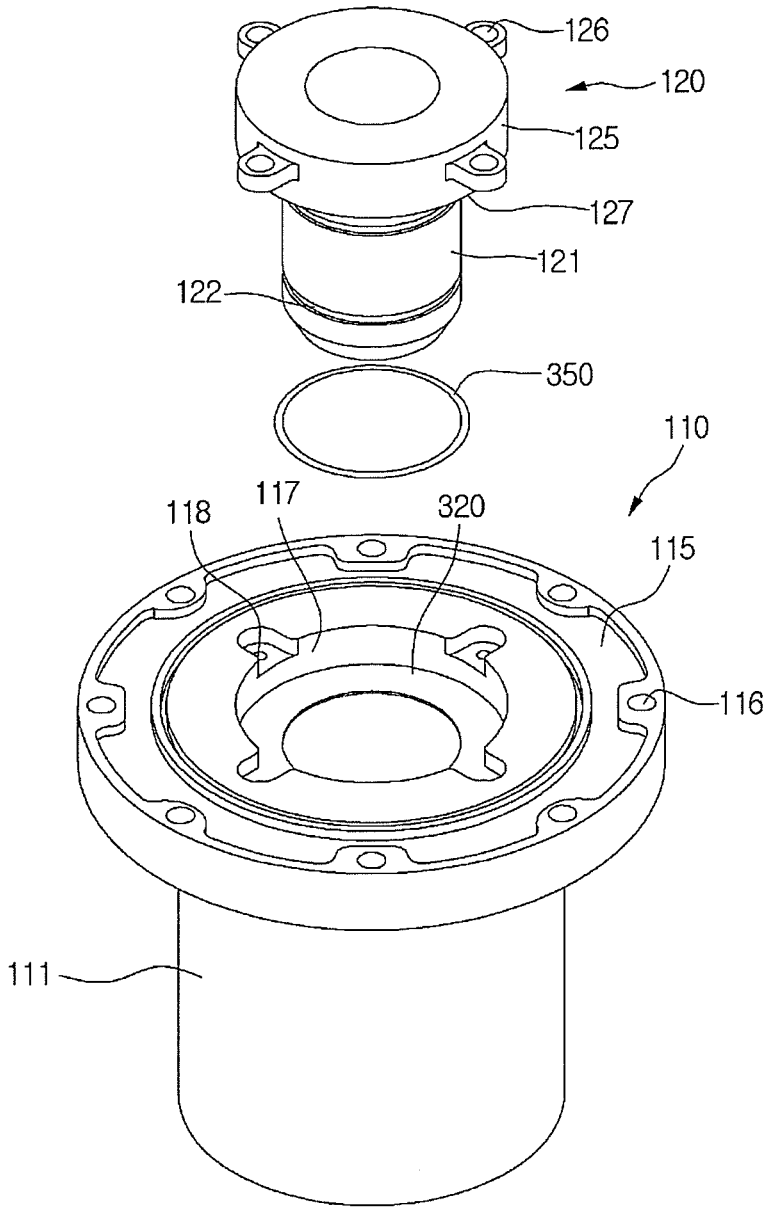
FIG. 8 is an exploded perspective view of the cylinder and the frame according to an embodiment.
Figure 9:
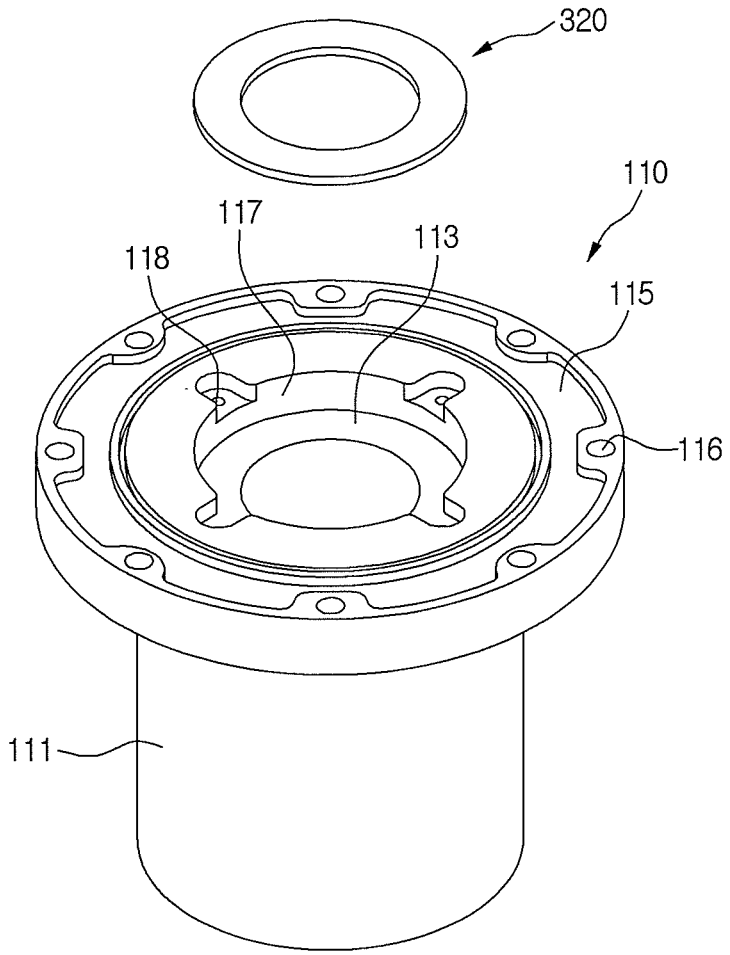
FIG. 9 is an exploded perspective of the frame according to an embodiment.
Figure 10:
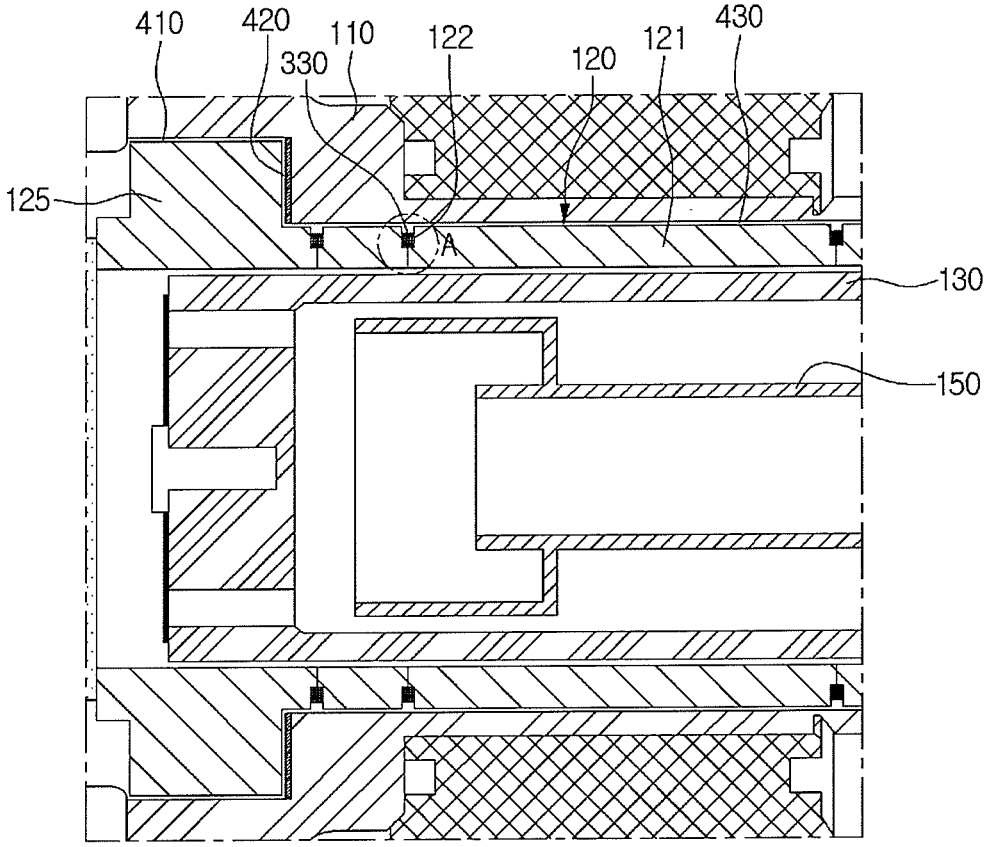
FIG. 10 is a cross-sectional view illustrating a state in which the cylinder and the piston are coupled to each other according to an embodiment.

FIG. 6 is a view illustrating components around a compression chamber according to an embodiment. FIG. 7 is an exploded perspective view of a coupled state between a cylinder and a frame according to an embodiment, FIG. 8 is an exploded perspective view illustrating configurations of the cylinder and the frame according to an embodiment. FIG. 9 is an exploded perspective of the frame according to an embodiment. FIG. 10 is a cross-sectional view illustrating a state in which the cylinder and the piston are coupled to each other according to an embodiment.

Referring to FIGS. 6 to 10, in the linear compressor 100 according to this embodiment, at least a portion of the refrigerant compressed in and discharged from the compression chamber P may flow into a space between the frame 110 and the cylinder 120. The space between the frame 110 and the cylinder 120 may be a gap defined between an inner surface of the frame 110 and an outer surface of the cylinder 120, which is formed by an assembly tolerance of the frame 110 and the cylinder 120.

Passages 410, 420, and 430 may be provided in the space between the frame 110 and the cylinder 120. The passage 410, 420, and 430 may include a first passage 410, a second passage 420, and a third passage 430, which may be successively provided in a flow direction of the refrigerant.

In detail, the cylinder 120 may include a cylinder body 121 having an approximately cylindrical shape, and a cylinder flange 125 that extends from the cylinder body 121 in a radial direction. The cylinder body 121 may include a gas inflow 122, through which the discharged gas refrigerant may be introduced. The gas inflow 122 may be formed in a circular shape along a circumferential surface of the cylinder body 121.

A plurality of the gas inflow 122 may be provided. The plurality of gas inflows 122 may include gas inflows (see reference numerals 122*a* and 122*b* of FIG. 11) disposed on or at one or a first side with respect to a center or central portion 121*c* of the cylinder body 121 in an axial direction, and a gas inflow (see reference numeral 122*c* of FIG. 11) disposed on or at the other or a second side with respect to the center or central portion 121*c* of the cylinder body 121 in the axial direction.

One or more coupling portion 126 coupled to the frame 110 may be disposed on the cylinder flange 125. Each coupling portion 126 may protrude outward from an outer circumferential surface of the cylinder flange 125, and be coupled to a cylinder coupling hole 118 of the frame 110 by a predetermined coupling member, for example, a bolt.

The cylinder flange 125 may have a seat surface 127 seated on the frame 110. The seat surface 127 may be a rear surface of the cylinder flange 125 that extends from the cylinder body 121 in the radial direction.

The frame 110 may include a frame body 111 that surrounds the cylinder body 121, and a cover coupling portion 115 that extends in a radial direction of the frame body 111 and coupled to the discharge cover 160. The cover coupling portion 115 may include a plurality of the cover coupling holes 116, in which the coupling member coupled to the discharge cover 160 may be inserted, and a plurality of the cylinder coupling holes 118, in which the coupling member coupled to the cylinder flange 125 may be inserted. The cylinder coupling holes 118 may be defined in or at positions recessed somewhat from the cover coupling portion 115.

A recess 117 that communicates with the frame body 111 may be provided in the frame 110. The recess 117 may be recessed backward from the cover coupling portion 115. The cylinder flange 125 may be inserted into the recess 117. That is, the recess 117 may be disposed to surround an outer circumferential surface of the cylinder flange 125. The recess 117 may have a recessed depth corresponding to a front/rear width of the cylinder flange 125.

A predetermined refrigerant flow space, that is, the first passage 410 may be defined between an inner circumferential surface of the recess 117 and the outer circumferential surface of the cylinder flange 125. In a state in which the cylinder 120 is assembled with the frame 110, a predetermined assembly tolerance may be provided between the outer circumferential surface of the cylinder flange 125 and the inner circumferential surface of the recess 117. A space corresponding to the assembly tolerance may be defined as the first passage 410.

The high-pressure gas refrigerant discharged through the discharge valve 161 may flow into the second passage 420 provided with a second filter 320 via the first passage 410. The second filter 320 may be a filter member disposed between the frame 110 and the cylinder 120 to filter the high-pressure gas refrigerant discharged through the discharge valve 161.

In detail, a seat 113 having a stepped portion may be disposed on a rear end of the recess 117. The seat 113 may extend inward from the recess 117 in a radial direction and may be disposed to face the seat surface 127 of the cylinder flange 125. The second filter 320 having a ring shape may be seated on the seat 113.

In a state in which the second filter 320 is seated on the seat 113, when the cylinder 120 is coupled to the frame 110, the cylinder flange 125 may push the second filter 320 from a front side of the second filter 320. That is, the second filter 320 may be disposed and fixed between the seat 113 of the frame 110 and the seat surface 127 of the cylinder flange 125.

The second passage 420 may be a passage through which the refrigerant having passed through the first passage 410 may flow. A predetermined assembly tolerance may be provided between the seat 113 and the seat surface 127 of the cylinder flange 125. A space corresponding to the assembly tolerance may be defined as the second passage 420.

The second filter 320 may be disposed in the second passage 420 to prevent foreign substances in the high-pressure gas refrigerant flowing into the second passage 420 from being introduced into the gas inflow 122 of the cylinder 120 and adsorb the oil contained in the refrigerant.

For example, the second filter 320 may include a felt formed of polyethylene terephthalate (PET) fiber or an adsorbent paper. The PET fiber may have superior heat-resistance and mechanical strength. Also, a foreign substance having a size of about 2 μm or more, which is contained in the refrigerant, may be blocked.

Although the second passage 420 is provided with the second filter 320 in this embodiment, embodiments are not limited thereto. For example, the second filter 320 may be provided in the first passage 410, that is, a space between the outer circumferential surface of the cylinder flange 125 and the inner circumferential surface of the recess 117 of the frame 110.

The passages 410, 420, and 430 may include a third passage 430, through which the refrigerant having passed through the second passage 420 may flow. The third passage 430 may extend backward from the second passage 420 along the outer circumferential surface of the cylinder body 121. The third passage 430 may extend up to a space between a rear portion of the frame body 111 and a first body end (see reference numeral 121*a* of FIG. 11) of the cylinder body 121. The refrigerant flowing into the third passage 430 may flow toward the inner circumferential surface of the cylinder 120 via the gas inflow 122 and the nozzle 123.

Figure 11:
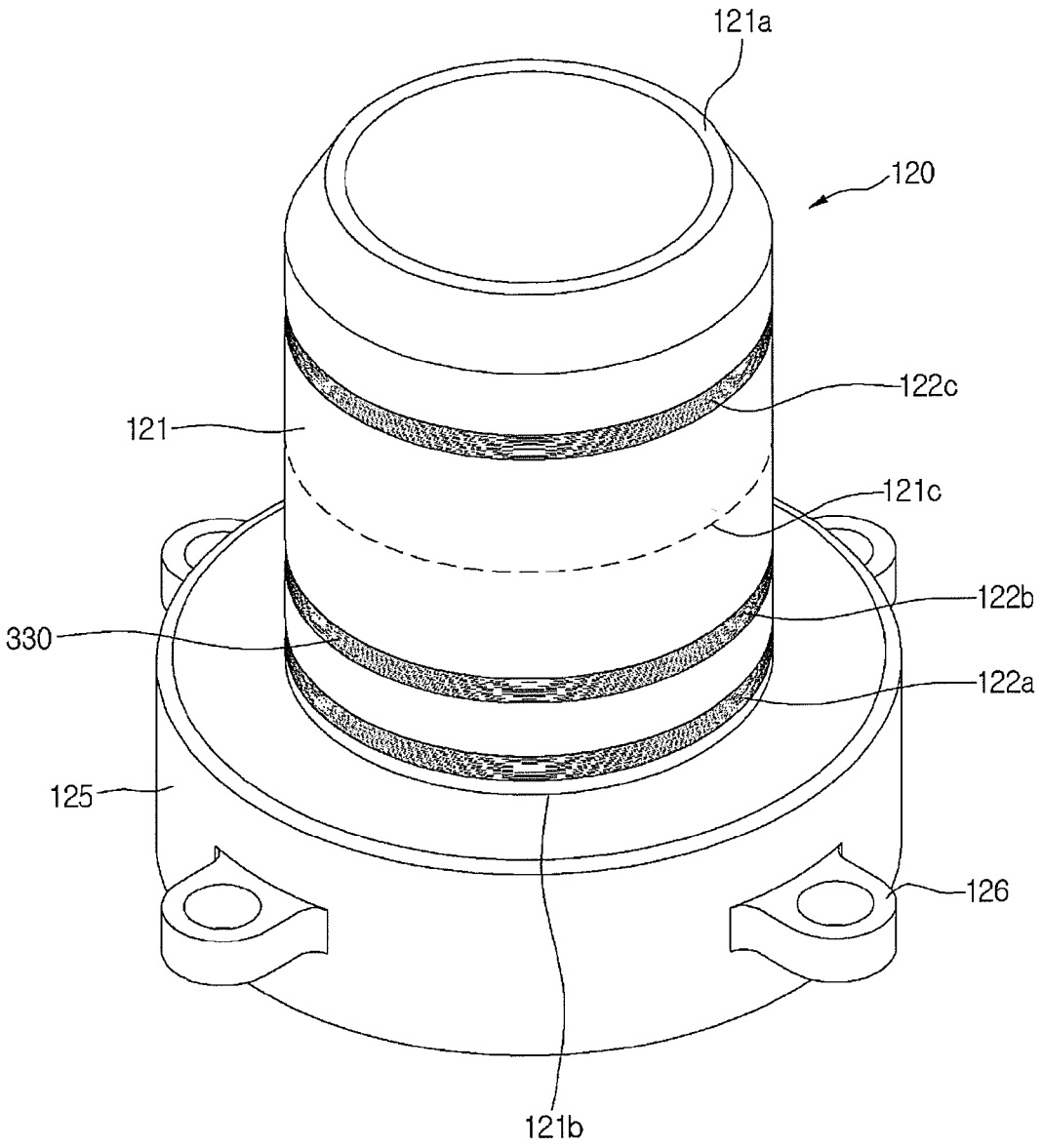
FIG. 11 is a view of the cylinder according to an embodiment.
Figure 12:
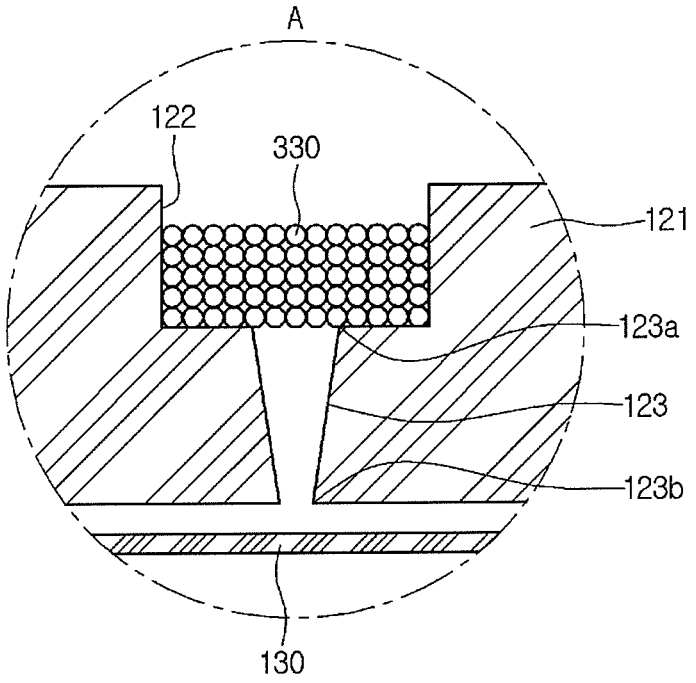
FIG. 12 is an enlarged cross-sectional view of portion A of FIG. 10.

FIG. 11 is a view of the cylinder according to an embodiment. FIG. 12 is an enlarged cross-sectional view of portion A of FIG. 10.

Referring to FIGS. 11 to 12, the cylinder 120 according to an embodiment may include the cylinder body 121 having an approximately cylindrical shape to form a first body end 121*a* and a second body end 121*b*, and the cylinder flange 125 that extends from the second body end 121*b* of the cylinder body 121 in the radial direction. The first body end 121*a* and the second body end 121*b* may form both ends of the cylinder body 121 with respect to the central portion 121*c* of the cylinder body 121 in the axial direction.

The cylinder body 121 may include a plurality of the gas inflows 122, through which at least a portion of the high-pressure gas refrigerant discharged through the discharge valve 161 may flow. The third filter 330 may be provided in the plurality of the gas inflows 122. The cylinder body 121 further include the one or more nozzle 123 that extends inward from the plurality of gas inflows 122 in the radial direction.

The plurality of gas inflows 122 and the nozzle(s) 123 may be understood as one component of the third passage 430. Thus, at least a portion of the refrigerant flowing into the third passage 430 may flow toward the inner circumferential surface of the cylinder 120 through the plurality of gas inflows 122 and the nozzle(s) 123. Each of the plurality of gas inflows 122 may be recessed from the outer circumferential surface of the cylinder body 121 by a predetermined depth and width.

The introduced refrigerant may be disposed between the outer circumferential surface of the piston 130 and the inner circumferential surface of the cylinder 120 to serve as the gas bearing with respect to movement of the piston 130. That is, the outer circumferential surface of the piston 130 may be maintained in a state in which the outer circumferential surface of the piston 130 is spaced apart from the inner circumferential surface of the cylinder 120 by pressure of the refrigerant.

The plurality of gas inflows 122 may include the first and second gas inflows 122*a* disposed on or at one or the first side with respect to the central portion 121*c* in the axial direction of the cylinder body 121, and the third gas inflow 122*c* disposed on or at the other or the second side with respect to the central portion 121*c* in the axial direction. The first and second gas inflows 122*a* and 122*b* may be disposed at positions closer to the second body end 121*b* with respect to the central portion 121*c* in the axial direction of the cylinder body 121, and the third gas inflow 122*c* may be disposed at a position closer to the first body end 121*a* with respect to the central portion 121*c* in the axial direction of the cylinder body 121. That is, the plurality of gas inflows 122 may be provided in numbers which are not symmetrical to each other with respect to the central portion 121*c* in the axial direction of the cylinder body 121.

Referring to FIG. 11, the cylinder 120 may have a relatively high inner pressure at a side of the second body end 121*b*, which may be closer to a discharge-side of the compressed refrigerant when compared to that of the first body end 121*a*, which may be closer to a suction-side of the refrigerant. Thus, more gas inflows 122 may be provided at the side of the second body end 121*b* to enhance the function of the gas bearing. However, relatively few gas inflows 122 may be provided on the side of the first body end 121*a*.

The cylinder body 121 may further include the nozzle 123 that extends from the plurality of gas inflows 122 toward the inner circumferential surface of the cylinder body 121. Each nozzle 123 may have a width or size less than a width or size of the gas inflow 122.

A plurality of the nozzle 123 may be provided along each gas inflow 122 which extends in a circular shape. The plurality of nozzles 123 may be disposed to be spaced apart from each other.

Each nozzle 123 include an inlet 123*a* connected to the respective gas inflow 122, and an outlet 123*b* connected to the inner circumferential surface of the cylinder body 121. The nozzle 123 may have a predetermined length from the inlet 123*a* to the outlet 123*b*.

A recessed depth and width of each of the plurality of gas inflows 122, and the length of the nozzle 123 may be determined to have adequate dimensions in consideration of a rigidity of the cylinder 120, an amount of the third filter 330, or an intensity in pressure drop of the refrigerant passing through the nozzle 123. For example, if the recessed depth and width of each of the plurality of gas inflows 122 are too large, or the length of the nozzle 123 is too short, the rigidity of the cylinder 120 may be weak. On the other hand, if the recessed depth and width of each of the plurality of gas inflows 122 are too small, an amount of third filter 330 provided in the gas inflow part 122 may be too small. Also, if the length of the nozzle part 123 is too long, a pressure drop of the refrigerant passing through the nozzle 123 may be too large, and it may be difficult to perform the function as the gas bearing.

The inlet 123*a* of the nozzle 123 may have a diameter greater than a diameter of the outlet 123*b*. In detail, if the diameter of the nozzle 123 is too small, an amount of refrigerant, which is introduced from the nozzle 123, of the high-pressure gas refrigerant discharged through the discharge valve 161 may be too large, increasing flow loss in the compressor. On the other hand, if the diameter of the nozzle 123 is too small, the pressure drop in the nozzle 123 may increase, reducing the performance as the gas bearing.

Thus, in this embodiment, the inlet 123*a* of the nozzle 123 may have a relatively large diameter to reduce the pressure drop of the refrigerant introduced into the nozzle 123. In addition, the outlet 123*b* may have a relatively small diameter to control an inflow amount of gas bearing through the nozzle 123 to a predetermined value or less.

The third filter 330 may be disposed in the plurality of gas inflows 122. The refrigerant flowing toward the inner circumferential surface of the cylinder 120 may be filtered by the third filter 330.

In detail, the third filter 330 may prevent a foreign substance having a predetermined size or more from being introduced into the cylinder 120 and perform a function to absorb oil contained in the refrigerant. The predetermined size may be about 1 μm.

The third filter 330 may include a thread wound around the gas inflow 122. The thread may be formed of a polyethylene terephthalate (PET) material and have a predetermined thickness or diameter.

The thickness or diameter of the thread may be determined to have adequate dimensions in consideration of a rigidity of the thread. If the thickness or diameter of the thread is too small, the thread may be easily broken due to a very weak strength thereof. On the other hand, if the thickness or diameter of the thread is too large, a filtering effect with respect to foreign substances may be deteriorated due to a very large pore in the gas inflow 122 when the thread is wound.

For example, the thickness or diameter of the thread may be several hundreds μm. The thread may be manufactured by coupling a plurality of strands of a spun thread having several tens μm to each other, for example.

The thread may be wound several times, and an end of the thread may be fixed through or by a knot. A number of windings of the thread may be adequately selected in consideration of a pressure drop of the gas refrigerant and the filtering effect with respect to foreign substances. If the number of thread windings is too large, the pressure drop of the gas refrigerant may increase. On the other hand, if the number of thread windings is too small, the filtering effect with respect to the foreign substances may be reduced.

Also, a tension force of the wound thread may be adequately controlled in consideration of a strain of the cylinder and fixation of the thread. If the tension force is too large, deformation of the cylinder 120 may occur. On the other hand, if the tension force is too small, the thread may not be well fixed to the gas inflow 122.

Figure 13:
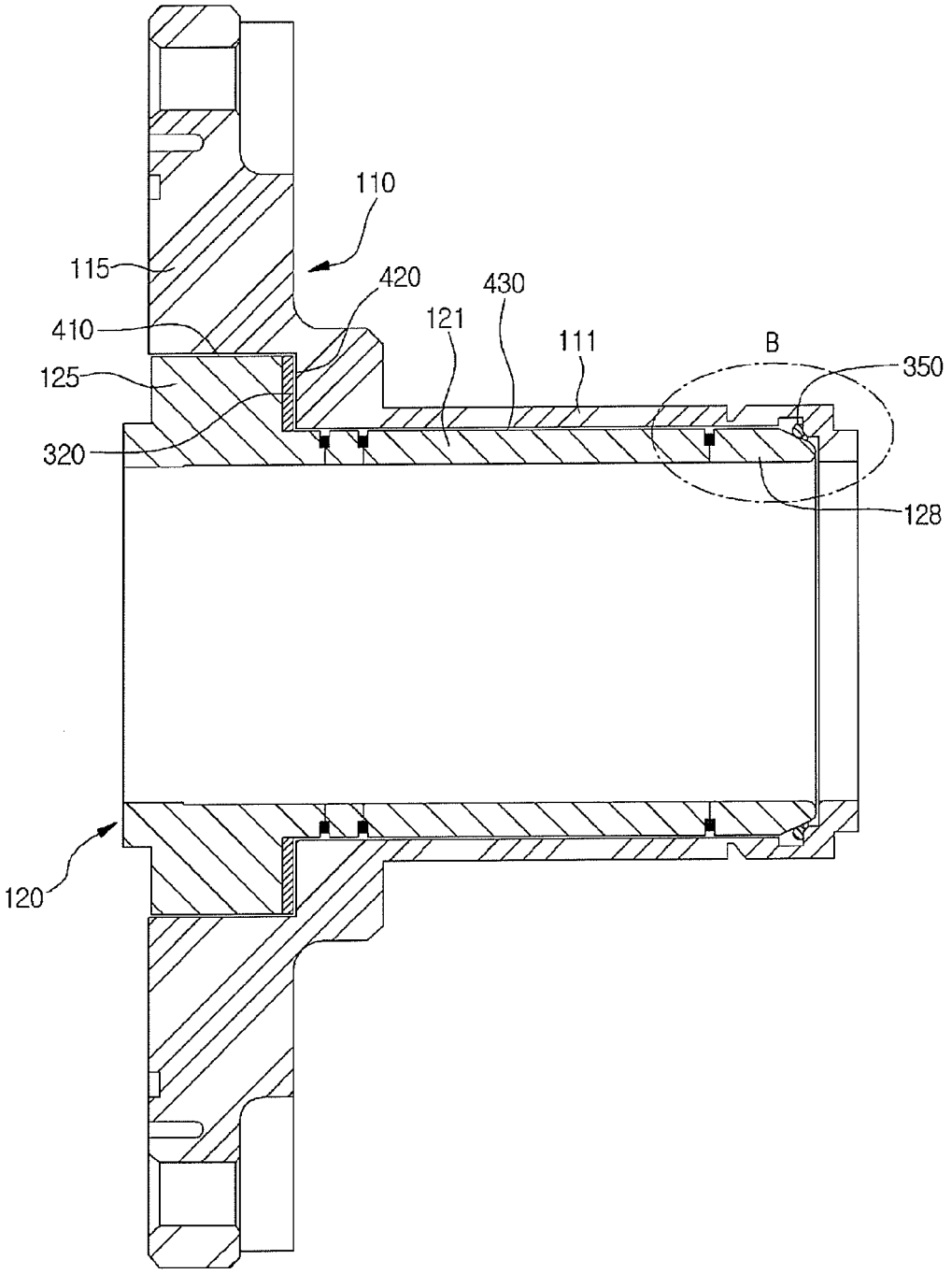
FIG. 13 is a cross-sectional view illustrating a state in which the cylinder and the piston are coupled to each other according to another embodiment.
Figure 14:
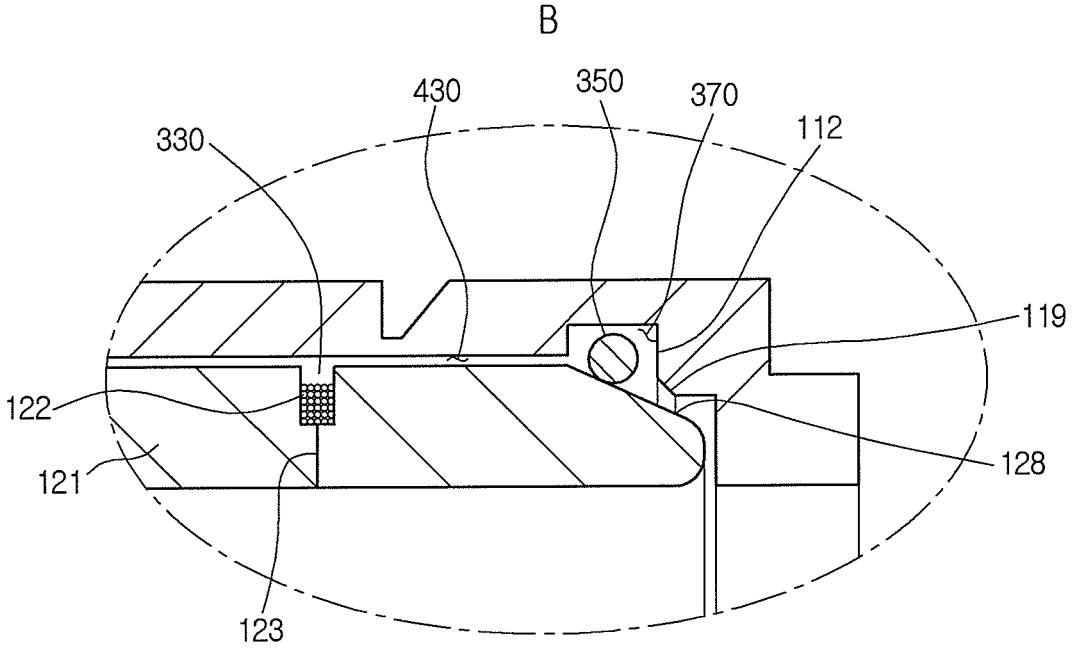
FIG. 14 is an enlarged view of portion B of FIG. 13.

FIG. 13 is a cross-sectional view illustrating a state in which the cylinder and the piston are coupled to each other according to an embodiment. FIG. 14 is an enlarged view of portion B of FIG. 13.

Referring to FIGS. 13 and 14, the linear compressor 100 according to an embodiment may include a sealing pocket 370 that communicates with the third passage 430 and on which the sealing member 350 may be disposed.

The sealing pocket 370 may be a space in which the sealing member 350 may be installed. The sealing pocket 370 may be defined between the inner circumferential surface of the frame body 111 and the outer circumferential surface of the cylinder body 121. The sealing pocket 370 may be defined in or at a rear side of the frame 110 and the cylinder 120. The sealing pocket 370 may have a flow cross-section area greater than a flow cross-section of the third passage 430 with respect to the flow direction of the refrigerant.

In detail, a pocket formation portion 112 recessed outward from the inner circumferential surface of the frame body 111 in the radial direction may be provided in or at a rear portion of the frame body 111. The pocket formation portion 112 may form at least a surface of the sealing pocket 370. The frame body 111 may further include a second inclined portion 119 that extends at incline inward and backward from the pocket formation portion 112.

The cylinder body 121 may include a first inclined portion 128 that forms the sealing pocket 370. The first inclined portion 128 may form at least one surface of the sealing pocket 370.

The first inclined portion 128 may extend at an incline backward and inward from the first body end 121*a* of the cylinder body 121. The first inclined portion 128 may extend from an inside of the pocket formation portion 112 up to a position corresponding to an inside of the second inclined portion 119.

A height of the sealing pocket 370 in the radial direction may be greater than a diameter of the sealing member 350 due to the recessed structure of the pocket formation 112 and the inclined structure of the first inclined portion 128. A length of the sealing pocket 370 in an axial direction may be greater than the diameter of the sealing member 350. That is, the sealing pocket 370 may have a sufficient size in which the sealing member may be movable without interfering with the frame body 111 or the cylinder body 121.

A gap or distance spaced between a rear portion of the first inclined portion 128 and a rear portion of the second inclined portion 119 may be less than the diameter of the sealing member 350. Thus, when the refrigerant flows backward along the third passage 430 while the linear compressor 100 operates, the sealing member 350 may be moved backward by the pressure of the refrigerant to seal the space.

As described above, as the sealing member 350 may be disposed between the cylinder 120 and the frame 110 to seal the third passage 430, and thus, may prevent the refrigerant in the third passage 430 from leaking outside of the frame 110. Also, when the sealing member 350 is movably provided in the sealing pocket 370, and the compressor operates to generate a flow of the refrigerant in the third passage 430, the sealing member 350 may press the cylinder 120 and the frame 110 to prevent the cylinder 120 from being deformed by a pressing force of the sealing member 350.

Hereinafter, a flow of the refrigerant while the linear compressor operates will be described.

Figure 15:
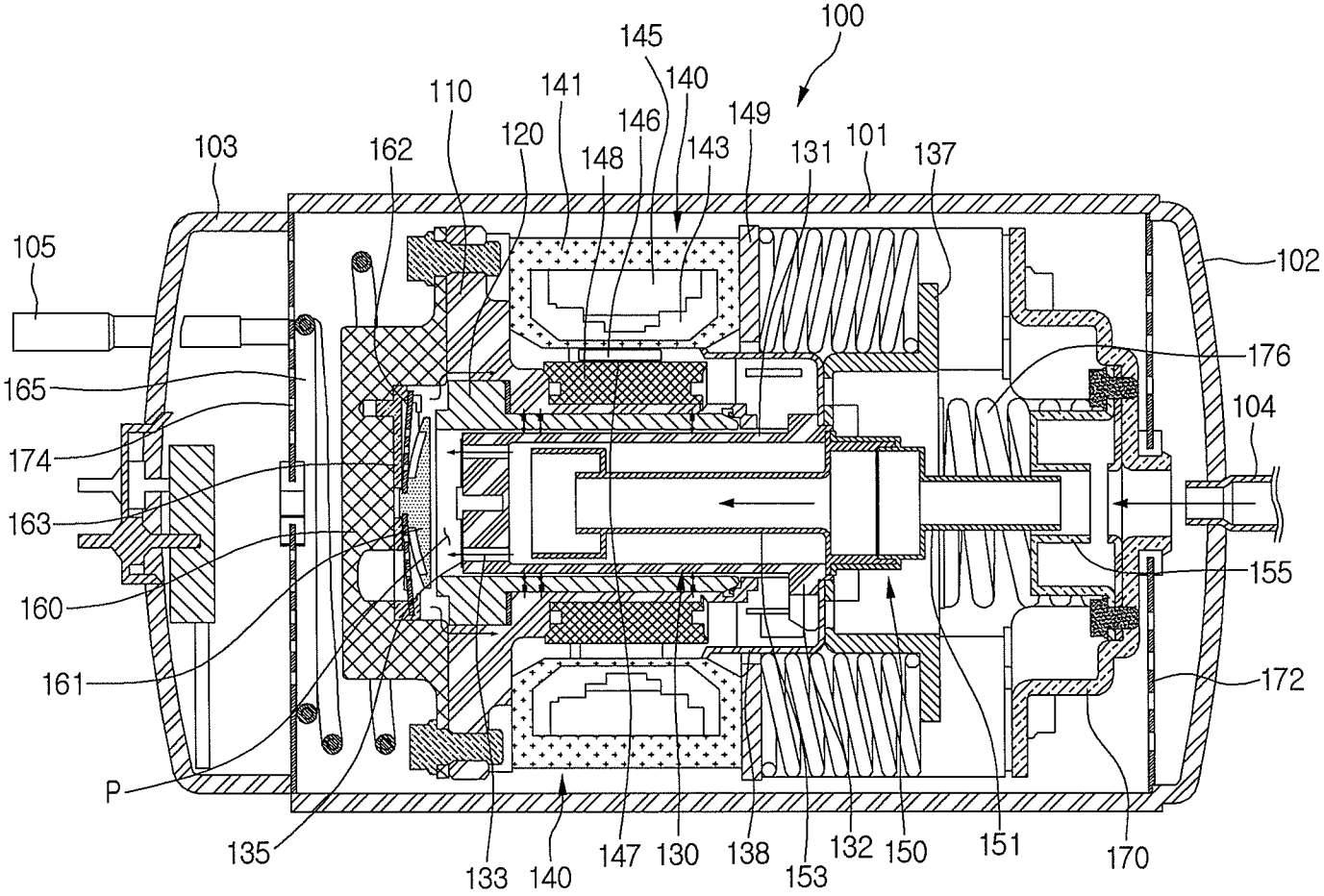
FIG. 15 is a cross-sectional view illustrating a refrigerant flow in the linear compressor according to an embodiment.
Figure 16:
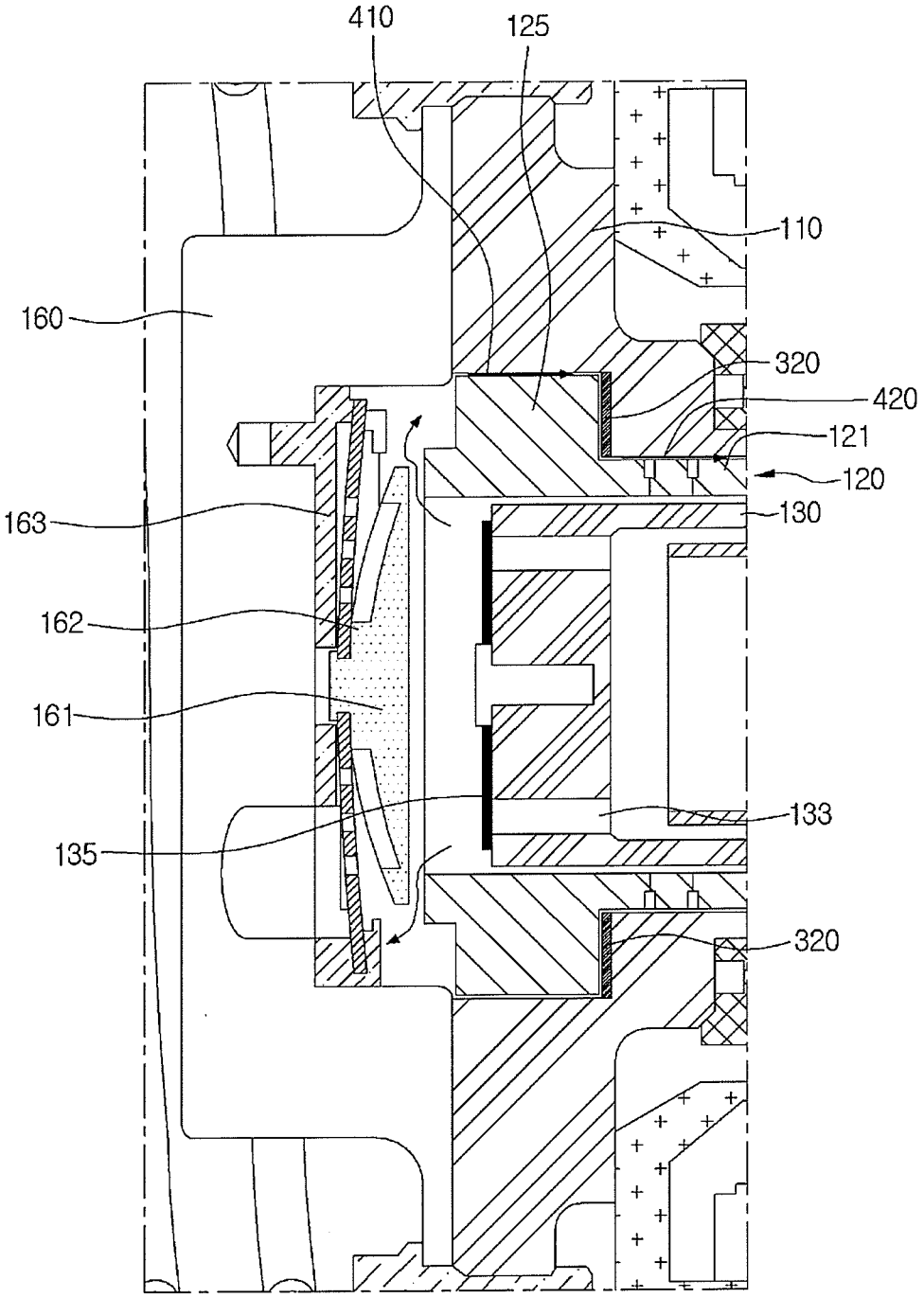
FIG. 16 is a view illustrating a flow of a refrigerant discharged from a compression chamber in first and second passages according to an embodiment.
Figure 17:
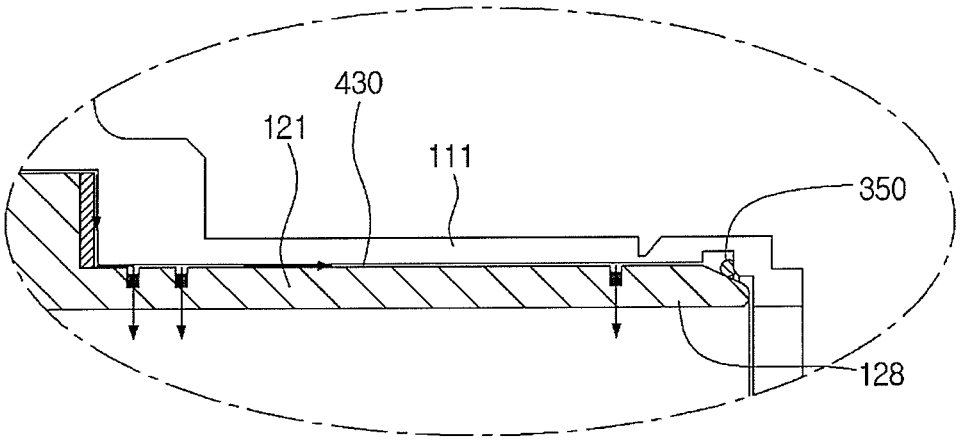
FIG. 17 is a view illustrating a flow of the refrigerant in a third passage according to an embodiment.

FIG. 15 is a cross-sectional view illustrating a refrigerant flow in the linear compressor according to an embodiment. FIG. 16 is a view illustrating a flow of a refrigerant discharged from a compression chamber in first and second passages according to an embodiment. FIG. 17 is a view illustrating a flow of the refrigerant in a third passage according to an embodiment.

A refrigerant flow in the linear compressor according to an embodiment will be described hereinbelow with reference to FIG. 15.

Referring to FIG. 15, the refrigerant may be introduced into the shell 101 through the suction inlet 104 and flow into the suction muffler 150 through the suction guide 155. The refrigerant may be introduced into the second muffler 153 via the first muffler 151 of the suction muffler 150 to flow into the piston 130. In this way, suction noise of the refrigerant may be reduced.

A foreign substance having a predetermined size (about 25 μm) or more, which is contained in the refrigerant, may be filtered while passing through the first filter 310 provided on or in the suction muffler 150. The refrigerant within the piston 130 after passing though the suction muffler 150 may be suctioned into the compression space P through the suction hole 133 when the suction valve 135 is opened.

When the refrigerant pressure in the compression space P is above the predetermined discharge pressure, the discharge valve 161 may be opened. Thus, the refrigerant may be discharged into the discharge space of the discharge cover 160 through the opened discharge valve 161. In detail, the discharge valve 161 may move forward and then be spaced apart from a front surface of the cylinder 120. In this way, the valve spring 162 may be elastically deformed in a forward direction. Also, the stopper 163 may restrict deformation of the valve spring 162 by a predetermined degree.

The refrigerant discharged into the discharge space of the discharge cover 160 may flow into the discharge outlet 105 through the loop pipe 165 coupled to the discharge cover 160, and then, may be discharged outside of the compressor 100. At least a portion of the refrigerant within the discharge space of the discharge cover 160 may flow into a space defined between the cylinder 120 and the frame 110, that is, the first passage 410 and the second passage 420. The refrigerant may be filtered by the second filter 320 while flowing into the first or second passages 410 or 420.

The filtered refrigerant may flow toward the outer circumferential surface of the cylinder body 121 through the third passage 430. At least a portion of the refrigerant may be introduced into the plurality of gas inflows 122 provided in the cylinder body 121. The refrigerant introduced into the plurality of gas inflows 122 may be filtered by the third filter 330, and then, may be introduced into the cylinder 120 through the nozzle(s) 123. The refrigerant introduced into the cylinder 120 may be disposed between the inner circumferential surface of the cylinder 120 and the outer circumferential surface of the piston 130 to space the piston 130 from the inner circumferential surface of the cylinder 120 (gas bearing).

As described above, the high-pressure gas refrigerant may be bypassed within the cylinder 120 to serve as the bearing with respect to the piston 130 which is reciprocated, thereby reducing abrasion between the piston 130 and the cylinder 120. Also, as oil is not used for the bearing, friction loss due to oil may not occur even though the compressor 100 operates at a high rate.

Also, as the plurality of filters may be provided on or in the passage of the refrigerant flowing into the compressor 100, foreign substances contained in the refrigerant may be removed. Thus, the refrigerant acting as the gas bearing may be improved in reliability. Thus, it may prevent the piston 130 or the cylinder 120 from being worn by foreign substances contained in the refrigerant.

Further, as the oil contained in the refrigerant may be removed by the plurality of filters, it may prevent friction loss due to the oil from occurring. The first, second, and third filters 310, 320, and 330 may be referred to as a "refrigerant filter device" in that the filters 310, 320, and 330 filter the refrigerant that serves as the gas bearing.

The refrigerant flowing into the third passage 430 may act on the sealing member 350. That is, pressure of the refrigerant may act on the sealing member 350. Thus, the sealing member 350 may move from the sealing pocket 370 to a position between the first inclined portion 128 of the cylinder 120 and the second inclined portion 119 of the frame 110.

Also, the sealing member 350 may be closely attached to the cylinder 120 and the frame 110 to seal the space between the cylinder 120 and the frame 110, that is, the space between the first inclined portion 128 and the second inclined portion 119. Thus, it may prevent the refrigerant within the third passage 430 from leaking outside through the space between the cylinder 120 and the frame 110.

When operation of the linear compressor 100 is stopped, the pressure of the refrigerant acting on the sealing member 350 may be released. Thus, adhesion between the cylinder 120 and the frame 110 may be weak. As a result, the sealing member 350 may move freely within the sealing pocket 220. For example, the sealing member 350 may be spaced apart from the first inclined portion 128 and the second inclined portion 119 (dotted line).

Due to the above-described effect, as the sealing member 350 is closely attached to the cylinder 120 and the frame 110 to perform the sealing of the third passage 430 only when the compressor 100 operates, a force applied from the sealing member 350 to the cylinder 120 may be reduced. Thus, deformation of the cylinder 120 may be prevented.

Also, as the sealing member 350 is movable in the sealing pocket 370, interference of the sealing member 350 when the cylinder 120 and the frame 110 are assembled with each other may be prevented. Therefore, the cylinder 120 and the frame 110 may be easily assembled with each other.

According to embodiments, the compressor including inner components may decrease in size to reduce a volume of a machine room of a refrigerator and increase an inner storage space of the refrigerant. Also, a drive frequency of the compressor may increase to prevent performance of the inner components from being deteriorated due to the decreasing size thereof. In addition, as the gas bearing is applied between the cylinder and the piston, a friction force occurring due to oil may be reduced.

Further, as at least a portion of the refrigerant compressed in and discharged from the compression chamber may flow toward the outer circumferential surface of the cylinder through the passage between the cylinder and the frame, and flow toward the inner circumferential surface of the cylinder through the gas inflow and the nozzle, the gas bearing may be easily formed. Furthermore, as the refrigerant uniformly flows toward the outer circumferential surface of the cylinder through the space defined between the cylinder and the frame, deformation of the cylinder due to the refrigerant may be prevented. Additionally, when the cylinder and the frame are assembled, as an assembly tolerance due to an outer diameter of the cylinder and an inner diameter of the frame is adjustable, a possibility of product failure due to blocking of the refrigerant passage may be reduced.

The sealing member to seal the refrigerant flow space between the cylinder and the frame may be movable, and the sealing member may seal the gap between the cylinder and the frame by the pressure of the refrigerant while the compressor operates to improve operational reliability. The pocket, on which the sealing member may be disposed, may have a size greater than a size of the sealing member to allow the sealing member to move. In addition, a force applied to the frame or the cylinder may be reduced by the sealing member. Thus, deformation of the cylinder formed of the aluminum material may be prevented.

Additionally, interference by the sealing member when the cylinder and the frame are assembled with each other may be reduced by the pocket, and thus, the cylinder and the frame may be easily assembled. Further, as the plurality of filtering device may be provided in the compressor, foreign substances or oil contained in the compression gas (or discharge gas) may be prevented from being introduced to the nozzle. In particular, the first filter may be provided on the suction muffler to prevent the foreign substances contained in the refrigerant from being introduced into the compression chamber. The second filter may be provided on the coupling portion between the cylinder and the frame to prevent the foreign substances and oil contained in the compressed refrigeration gas from flowing into the gas inflow of the cylinder. The third filter may be provided on or in the gas inflow of the cylinder to prevent the foreign substances and oil from being introduced into the nozzle of the cylinder from the gas inflow.

Also, the filter device may be provided on the dryer provided in the refrigerator to filter moisture, foreign substances, or oil contained in the refrigerator. As described above, as the foreign substances or oil contained in the compression gas that acts as the bearing are filtered through the plurality of filtering devices provided in the compressor and dryer, it may prevent the nozzle of the cylinder from being blocked by the foreign substances or oil. As the blocking of the nozzle of the cylinder is prevented, the gas bearing effect may be effectively performed between the cylinder and the piston, and thus, abrasion of the cylinder and the piston may be prevented.

Embodiments disclosed herein provide a linear compressor, in which a gas bearing may easily operate between a cylinder and a piston.

Embodiment disclosed herein provide a linear compressor that may include a shell including a suction inlet; a cylinder provided in the shell to define a compression space for a refrigerant; a piston reciprocated in an axial direction within the cylinder; a discharge valve provided on or at one side of the cylinder to selectively discharge the refrigerant compressed in the compression space; a nozzle disposed in the cylinder to introduce at least a portion of the refrigerant discharged through the discharge valve into the cylinder; and a passage to guide the refrigerant discharged from the discharge valve into the nozzle. The linear compressor may further include a frame coupled to the cylinder to surround an outside of the cylinder.

The passage may be defined between an outer circumferential surface of the cylinder and an inner circumferential surface of the frame. The cylinder may include a cylinder body including the nozzle part or nozzle, and a cylinder flange part or flange that extends outward from the cylinder body in a radial direction.

The frame may include a frame body that surrounds the cylinder body, and a recess part or recess, in which the cylinder flange part may be inserted. The recess part may communicate with the frame body.

The passage may include a first passage defined between an outer circumferential surface of the cylinder flange part and an inner circumferential surface of the recess part. The frame may further include a seat part or seat that extends inward from the recess part in the radial direction and on which a seat surface of the cylinder flange part may be seated.

The passage may further include a second passage defined between the seat part and the seat surface of the cylinder flange part. A second filter may be disposed in the second passage. The second filter may include a felt formed of polyethylene terephthalate (PET) fiber or an adsorption paper.

The passage may further include a third passage that extends from the second passage to a space between an outer circumferential surface of the cylinder body and an outer circumferential surface of the frame body.

The linear compressor may further include a gas inflow part or inflow recessed from the outer circumferential surface of the cylinder body to communicate with the nozzle part. At least a portion of the refrigerant flowing into the third passage may flow toward the inner circumferential surface of the cylinder body through the gas inflow part and the nozzle part. A third filter including a thread may be disposed in the gas inflow part.

The linear compressor may further include a sealing pocket that communicates with the third passage, and a sealing member movably disposed on or in the sealing pocket to seal a space between the inner circumferential surface of the frame and the outer circumferential surface of the cylinder.

Embodiments disclosed herein further provide a linear compressor that may include a shell including a suction inlet; a cylinder provided in the shell to define a compression space for a refrigerant; a frame coupled to an outside of the cylinder; a piston reciprocated in an axial direction within the cylinder; a discharge valve movably coupled to the cylinder to selectively discharge the refrigerant compressed in the compression space for the refrigerant; and a passage through which at least a portion of the refrigerant discharged from the discharge valve may flow. The passage may extend to a space between the cylinder and the frame.

The cylinder may include a cylinder body including a nozzle part or nozzle, and a cylinder flange part or flange that extends outward from the cylinder body in a radial direction. The frame may include a frame body that surrounds the cylinder body; a recess part or recess, in which the cylinder flange part may be inserted; and a seat part or seat that faces a seat surface of the cylinder flange part.

The passage may include a first passage defined between an outer circumferential surface of the cylinder flange part and an inner circumferential surface of the recess part. The passage may include a second passage defined between the seat surface of the cylinder flange part and the seat part of the frame.

The passage may include a third passage that extends from the second passage to a space between an outer circumferential surface of the cylinder body and an inner circumferential surface of the frame body. The cylinder body may further include a nozzle part or nozzle, in which the refrigerant may be introduced, and at least a portion of the refrigerant flowing into the third passage may flow toward an inner circumferential surface of the cylinder through the nozzle part.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a shell;

a cylinder provided in the shell to define a compression space for a refrigerant, the cylinder including a cylinder body and a cylinder flange that extends outward from the cylinder body in a radial direction and has a seat surface;

a piston reciprocated in an axial direction within the cylinder;

a discharge valve provided at one end of the cylinder to selectively discharge the refrigerant compressed in the compression space;

at least one nozzle provided in the cylinder body to introduce at least a portion of the refrigerant discharged through the discharge valve into the cylinder;

a discharge cover that defines a discharge space in which the discharge valve discharges the refrigerant;

a frame coupled to an outside of the cylinder, the frame including a frame body that surrounds the cylinder body, a cover coupling portion that extends in a radial direction of the frame body and is coupled to the discharge cover, a recess recessed from the cover coupling portion and into which the cylinder flange is inserted and a seat that extends inward from the recess in the radial direction and on which the seat surface is seated;

a first passage formed between the seat of the frame and the seat surface of the cylinder flange, the first passage being configured to guide the refrigerant discharged from the discharge valve into the at least one nozzle; and a filter provided in the first passage and including a felt formed of polyethylene terephthalate (PET) fiber or an adsorption paper, the filter having a ring shape such that the cylinder flange pushes the filter when the filter is seated on the seat and the cylinder is coupled to the frame.

2. The linear compressor according to claim 1, further comprising a second passage defined between an outer circumferential surface of the cylinder flange and an inner circumferential surface of the recess.

3. The linear compressor according to claim 2, further comprising a third passage that extends from the first passage to a space between an outer circumferential surface of the cylinder body and an inner circumferential surface of the frame body.

4. The linear compressor according to claim 3, further comprising at least one gas inflow recessed from the outer circumferential surface of the cylinder body to communicate with the at least one nozzle, wherein at least a portion of the refrigerant flowing into the third passage flows toward an inner circumferential surface of the cylinder body through the at least one gas inflow and the at least one nozzle.

5. The linear compressor according to claim 4, further comprising a second filter installed in the at least one gas inflow, the second filter comprising a thread.

6. The linear compressor according to claim 5, further comprising:

a sealing pocket that communicates with the third passage; and a sealing member movably installed in the sealing pocket to seal a space between the inner circumferential surface of the frame and the outer circumferential surface of the cylinder.

7. The linear compressor according to claim 6, wherein the sealing pocket has a flow cross-sectional area greater than a flow cross-sectional area of the third passage with respect to a flow direction of the refrigerant.

8. The linear compressor according to claim 6, wherein the sealing pocket is defined by a first inclined portion of the cylinder body and a pocket formation part that is recessed from the inner circumferential surface of the frame body.

9. The linear compressor according to claim 6, wherein a length of the sealing pocket in an axial direction is greater than a diameter of the sealing member such that the sealing member is movable within the sealing pocket.

10. The linear compressor according to claim 4, wherein the at least one gas inflow includes a first gas inflow, a second gas inflow, and a third gas inflow, wherein the first gas inflow and the second gas inflow are provided close to an end of the cylinder body at which the refrigerant is discharged, and the third gas inflow is provided close to another end of the cylinder body at which the refrigerant is suctioned.

11. The linear compressor according to claim 4, wherein the at least one gas inflow includes a first gas inflow, a second gas inflow, and a third gas inflow, which are provided asymmetrically with respect to a central portion in an axial direction of the cylinder body.

12. The linear compressor according to claim 4, wherein the at least one nozzle includes an inlet connected to the at least one gas inflow and an outlet connected to the inner circumferential surface of the cylinder body, wherein a diameter of the inlet is greater than a diameter of the outlet.

13. The linear compressor according to claim 3, wherein the third passage extends perpendicularly from the first passage.

14. The linear compressor according to claim 2, wherein the first passage extends perpendicularly from the second passage.

* * * * *